US007705295B2

(12) United States Patent
Jeffryes

(10) Patent No.: US 7,705,295 B2
(45) Date of Patent: Apr. 27, 2010

(54) METHODS AND SYSTEMS FOR DETERMINING MUD FLOW VELOCITY FROM MEASUREMENT OF AN AMPLITUDE OF AN ARTIFICIALLY INDUCED RADIATION

(75) Inventor: Benjamin Jeffryes, Histon (GB)

(73) Assignee: Schlumberger Technology Corporation, Cambridge, MA (US)

( * ) Notice: Subject to any disclaimer, the term of this patent is extended or adjusted under 35 U.S.C. 154(b) by 29 days.

(21) Appl. No.: 11/959,203

(22) Filed: Dec. 18, 2007

(65) Prior Publication Data

US 2008/0156977 A1 Jul. 3, 2008

(30) Foreign Application Priority Data

Dec. 23, 2006 (GB) ..... 0625904.8

(51) Int. Cl.
*G01V 5/00* (2006.01)
*E21B 47/12* (2006.01)

(52) U.S. Cl. ..... 250/262; 250/269.7; 250/269.8; 73/152.21; 73/152.18

(58) Field of Classification Search ..... 73/152.21
See application file for complete search history.

(56) References Cited

U.S. PATENT DOCUMENTS 3,603,795 A * 9/1971 Allaud ..... 376/167
4,233,508 A * 11/1980 Arnold ..... 250/259
5,440,118 A 8/1995 Roscoe
5,539,225 A 7/1996 Loomis et al.
5,786,595 A 7/1998 Herron et al.

FOREIGN PATENT DOCUMENTS

| | | | |
|---|---|---|---|
| GB | 2331361 A | | 5/1999 |
| GB | 2399111 A | | 9/2004 |
| WO | WO 2004059125 | * | 7/2004 |
| WO | WO 2004079161 | * | 9/2004 |
| WO | 2006004740 A2 | | 1/2006 |
| WO | 2006004740 A3 | | 1/2006 |

OTHER PUBLICATIONS

Albertin et al., "The many facets of pulsed neutron cased-hole logging", Schlumberger Oilfield Review, Summer 1996, vol. 8, No. 2, pp. 28-41.

* cited by examiner

*Primary Examiner*—David P Porta
*Assistant Examiner*—Yara B Green
(74) *Attorney, Agent, or Firm*—James McAleenan; Helene Raybaud; Brigid Laffey

(57) ABSTRACT

Embodiments of the present invention relate in general to methods and apparatus for determining downhole mud flow rates and other downhole parameters. More specifically, but not by way of limitation, an embodiment of the present invention may provide a method for determining a downhole parameter that includes operating a pulsed neutron generator, detecting the activated drilling fluid at at-least one known distance (d) from the pulsed neutron generator, and determining a time-of-flight (t) for the activated drilling fluid slug to travel from the pulsed neutron generator to a detection point, or between detection points

17 Claims, 7 Drawing Sheets

METHODS AND SYSTEMS FOR DETERMINING MUD FLOW VELOCITY FROM MEASUREMENT OF AN AMPLITUDE OF AN ARTIFICIALLY INDUCED RADIATION

CROSS-REFERENCE TO RELATED APPLICATIONS

This application claims the benefits of priority from Application Number 0625904.8, entitled "METHODS AND SYSTEMS FOR DETERMINING MUD FLOW VELOCITY FROM MEASUREMENT OF AN AMPLITUDE OF AN ARTIFICIALLY INDUCED RADIATION," filed in the United Kingdom on Dec. 23, 2006, which is commonly assigned to assignee of the present invention and hereby incorporated by reference in its entirety.

BACKGROUND

When drilling a borehole through a geologic formation, it is important to know the downhole conditions to ensure that the drill bit is operating correctly. These conditions include, among other things, the diameter of the borehole and, therefore, the volume of the drilling fluid at any given point. In addition, the formation properties may be measured to predict the presence of oil or gas. Formation properties may be logged with wireline tools, logging while drilling ("LWD") tools, or measurement while drilling ("MWD") tools. Modern oil and gas explorations typically use LWD or MWD tools, instead of wireline tools, for formation logging due to the saving in time and costs.

Various LWD and MWD tools are in use for measuring borehole or formation properties. For example, LWD neutron or gamma spectroscopy logs may be used to provide lithology, formation porosity, and formation density information. Neutron/gamma spectroscopy may be performed by sending a pulse of neutrons into the formation using a pulsed neutron generator ("PNG"). The neutrons interact with elements in the formation by inelastic interactions or elastic interactions. The high-energy neutrons gradually lose their energy through these interactions to become thermal neutrons, which may be captured by the nuclei of various elements in the formation. After neutron capture, these elements become activated. The activated elements then decay by emitting gamma rays. The gamma rays emitted by these activated elements may be detected with gamma ray detectors. Because different elements produce gamma rays of different energies, the captured gamma ray spectra may be used to derive the elemental compositions of the formation. The elemental yields in turn may be used to provide formation lithology because different sediment layers are typically enriched with different types of elements.

Methods for neutron and gamma ray logging may be found in, for example, U.S. Pat. No. 5,440,118 to Roscoe, U.S. Pat. No. 5,786,595 to Herron et al., U.S. Pat. No. 5,539,225 to Loomis et al. and in Albertin et al., "The many facets of pulsed neutron cased-hole logging," Schlumberger Oilfield Review, Vol. 8, No. 2, pp. 28-41 (1996).

In borehole drilling, large quantities of drilling fluids are pumped through the drill strings into the boreholes while the boreholes are being drilled. The drilling fluids help cool the cutting surfaces of the drill bits and help carry out the earth cuttings from the bottom of the borehole when they flow up the annulus to the surface. To prevent formation fluids from flowing into the borehole during the drilling process, the drilling fluids are pumped under a pressure that is slightly higher than the expected formation pressure. The higher hydraulic pressure of the drilling fluids may result in a substantial loss of fluid into the formation when a permeable and low pressure zone of the earth formation is encountered. Detection of such fluid loss may be used in correction of the measurements of various LWD sensors. Fluid loss into the formation may be detected by the reduced flow back of the drilling fluids on the surface. However, for determining in what zone the fluid loss is occurring, means of detecting volumetric flows along the axial depth of the borehole may be needed.

During periods, such as drill pipe connections, when drilling fluid flow is stopped and then restarted, the bottom hole pressure is less than the flowing pressure, due to the absence of pressure drops in the annulus due to flowing friction. It is often indirectly observed from downhole pressure measurements that when drilling fluid flow ceases, additional fluid flows out of the formation—which is then taken up again on the resumption of fluid flow from the surface. This phenomenon is known as wellbore breathing, and an assessment of the pressures and volumes involved can be used in inferring properties of the formation. However, inference of the fluid volumes and rates observed is difficult due to the lack of a direct flow rate measurement in the annulus. Measurement of the annular fluid flow rate over short periods, such as those occurring during changes in the surface flow rate, require a continuous measurement of annular flow velocity.

BRIEF SUMMARY OF THE INVENTION

Embodiments of the present invention relate to systems and methods for determining downhole parameters. More specifically, but not by way of limitation, an embodiment of the present invention provides a method for determining a downhole parameter in a drilling environment in accordance with embodiments of the invention includes: operating a pulsed neutron generator (6) to activate drilling fluid flowing past the neutron generator; and to measure the amplitude of radiation emitted by the activated drilling fluid at a detector (7) downstream of the PNG. In some embodiments, the amplitude of radiation emitted by the activated drilling fluid may be measured at a second detector (77) further downstream of the PNG, and, in certain aspects, the logarithm of the relative amplitude may be used to infer the time for the drilling fluid to travel between the two detectors through knowledge of the decay rate of induced radioactive species contained in the fluid. In other embodiments the continuously-measured amplitude may be combined with other flow velocity measurements, which do not provide a continuous measurement of annular mud flow speed, but which may be used to calibrate the amplitude and from this derive a continuous annular mud flow velocity.

Other aspects and advantages of the invention will be apparent from the following description and the appended claims.

BRIEF DESCRIPTION OF THE DRAWINGS

The present invention will become more fully understood from the detailed description and the accompanying drawings, wherein.

Figure 1:
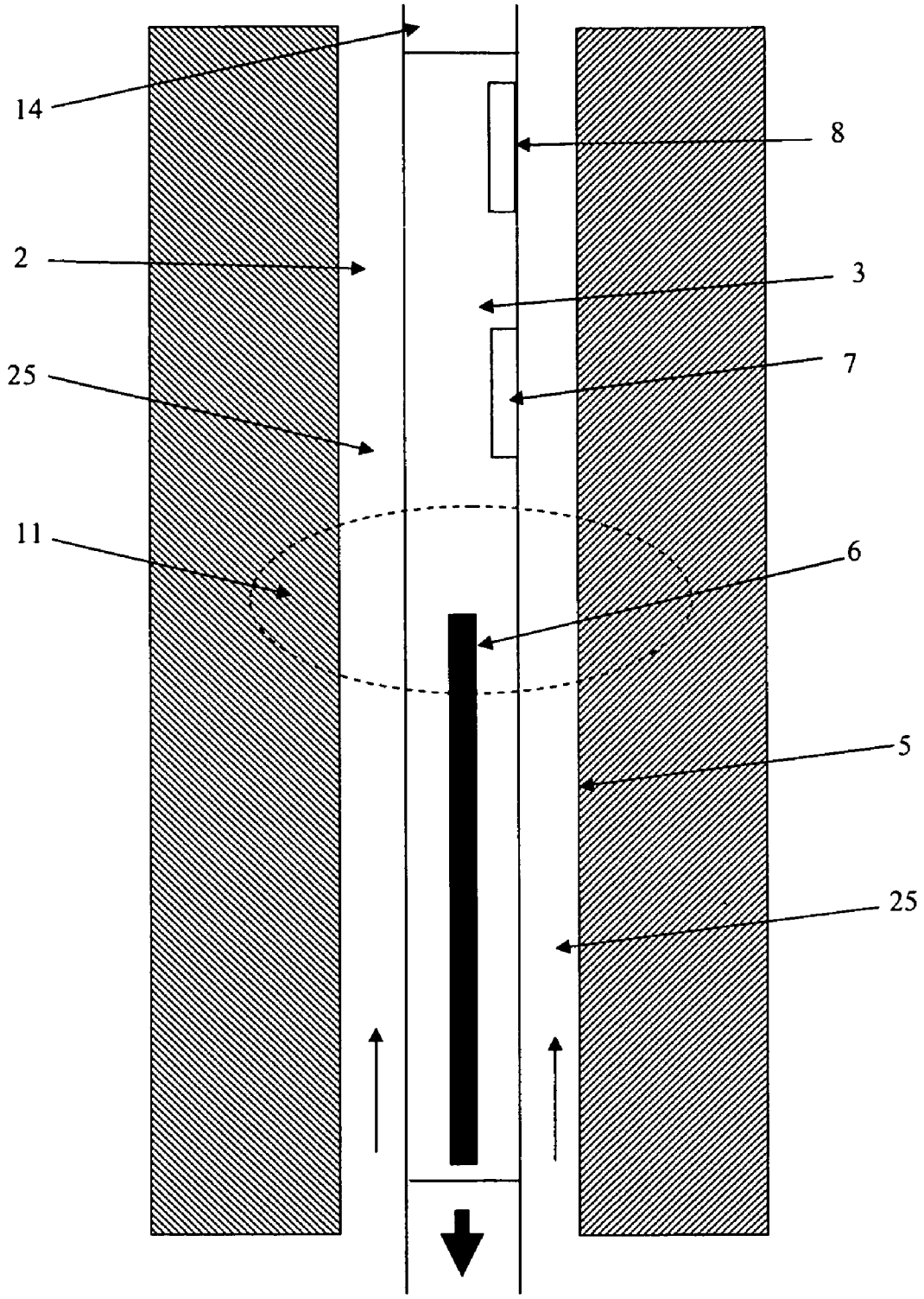
FIG. 1 shows an LWD tool, in accordance with one embodiment of the present invention.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

Specific details are given in the following description to provide a thorough understanding of the embodiments. However, it will be understood by one of ordinary skill in the art that the embodiments may be practiced without these specific details. For example, circuits may be shown in block diagrams in order not to obscure the embodiments in unnecessary detail. In other instances, well-known circuits, processes, algorithms, structures, and techniques may be shown without unnecessary detail in order to avoid obscuring the embodiments.

Also, it is noted that the embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure. A process may correspond to a method, a function, a procedure, a subroutine, a subprogram, etc. When a process corresponds to a function, its termination corresponds to a return of the function to the calling function or the main function.

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention. It being understood that various changes may be made in the function and arrangement of elements without departing from the scope of the invention as set forth in the appended claims.

The invention relates to methods and apparatus for determining flow velocities of drilling fluids ("muds") in boreholes. The invention, advantageously, may be used while drilling a borehole. The fluid velocity permits the calculation of other downhole parameters, such as the volumetric flow rate of the mud.

In some embodiments, the invention relies on the activation of oxygen in the drilling mud. In the activation process, oxygen atoms in the drilling mud are transformed from stable atoms into radioactive atoms by the bombardment of neutrons. When an oxygen-16 atom absorbs a neutron (neutron capture), it may emit a proton to produce a radioactive nitrogen-16 atom. Nitrogen-16, with a half-life of about 7.1 seconds, decays to oxygen-16 by emitting a beta particle. The oxygen-16 that results from the beta decay of nitrogen-16 is in an excited state, and it releases the excitation energy by gamma ray emission. The gamma ray emission may be detected by a gamma ray detector.

Embodiments of the present invention may be used with an LWD neutron tool with no interference with normal operations of the tool, i.e., they permit the PNG to be continuously operated for LWD measurements. Neutron logs typically are used to measure the porosity of the formation. In addition, elements in the formation may become activated after capturing thermal neutrons. The activated elements then emit gamma rays when they return to ground states. These gamma rays may be detected with gamma ray detectors for deriving formation density or lithology.

FIG. 1 shows an LWD tool 3 in a borehole 2, in accordance with an embodiment of the present invention. The LWD tool may be part of the drill string 14. The LWD tool 3 comprises a PNG 6, a near gamma ray detector 7 and a far gamma ray detector 8 that may be spaced apart by a known distance d. The PNG 6 has an activation zone 11, within which atoms are activated by the neutrons emitted from the PNG 6. As the drilling mud, flowing upward in the annulus 25 between the LWD tool 3 and the borehole wall 5, passes through the activation zone 11, oxygen in the mud is activated. Arrows in the figure indicate the direction of mud flow. When the mud passes the near gamma ray detector 7, the gamma rays emitted by the activated oxygen may be detected. As it passes the far gamma ray detector 8 the gamma rays are again detected. For a borehole of constant cross-section between the two detectors, the activity measured at the detector 77 will be less than that at detector 7 due to the radioactive decay of the activated oxygen contained in the mud. If a is the amplitude of the radiation at detector 8 and b is the amplitude at detector 7, and $\beta$ is the decay constant for activated oxygen, then the time-of-flight $t_1$ for the mud to flow from detector 7 to detector 8 may be given by $$t_1 = \frac{1}{\beta}\log\left(\frac{b}{a}\right) \tag{1}$$

Figure 2:
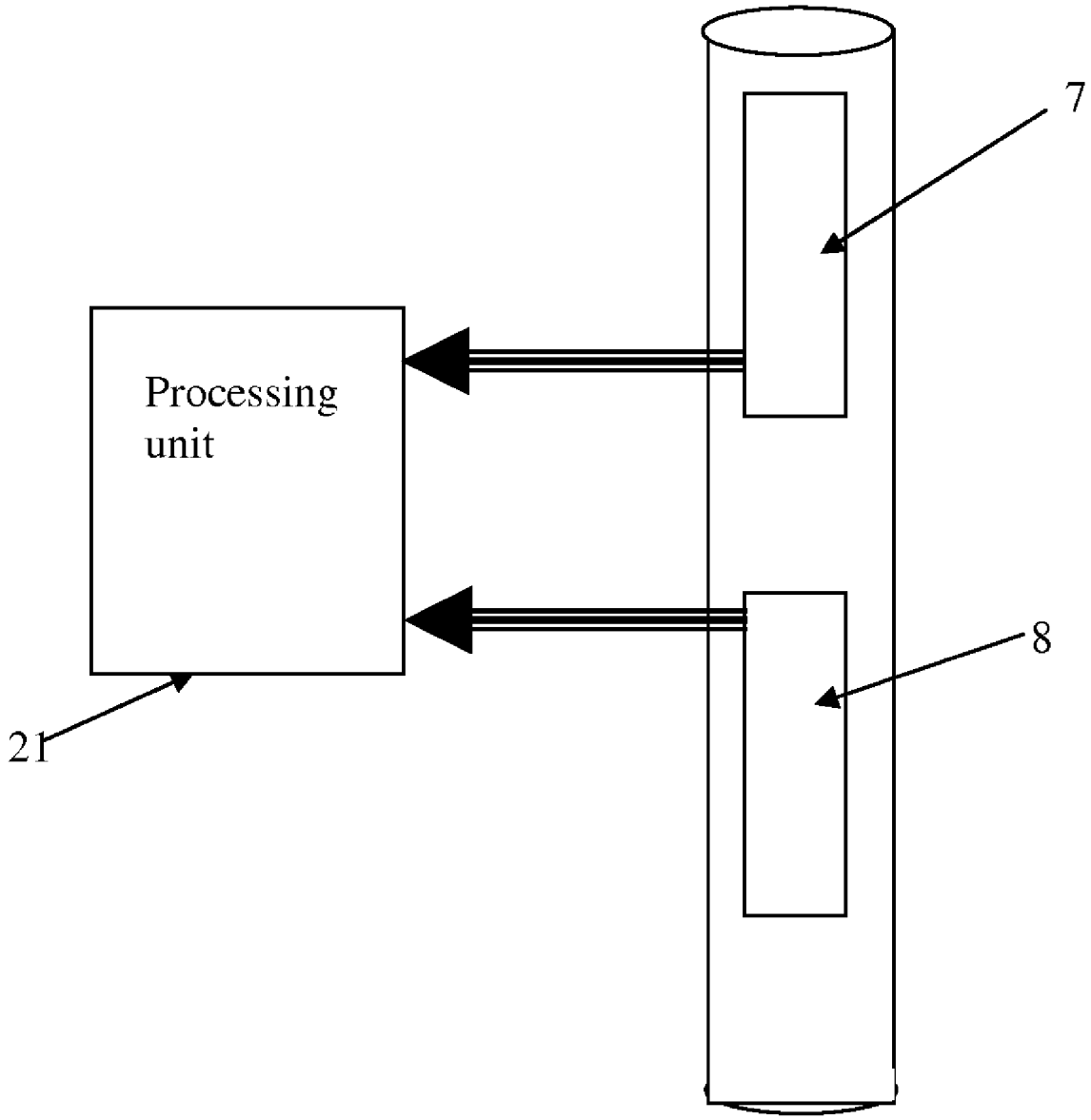
FIG. 2 shows a schematic diagram of circuitry, in accordance with an embodiment of the present invention.

FIG. 2 shows the components necessary to calculate the time-of-flight t, in accordance with an embodiment of the present invention. The measurements made at the two gamma ray detectors 7 and 8 may be communicated to a processing unit 21, where the time-of-flight $t_1$ may be calculated. The processing unit 21 may be combined in the LWD with the detectors 7 and 8, or it may be in another location (such as at the surface) with the measurements communicated to it either using a real-time telemetry means, such as mud-pulse telemetry, transferred to it from memory in the LWD tool when the LWD tool is withdrawn from the ground, wirelessly communicated and/or the like. In addition, the processor 21 may perform various other calculations as set forth in the embodiments below. One of ordinary skill in the art will recognize that the processor 21 may be dedicated to the functionality of this invention or, more likely, may be a processor of general functionality to the tool. The processor may be a computer, software run on a processor and/or the like.

Figure 3:
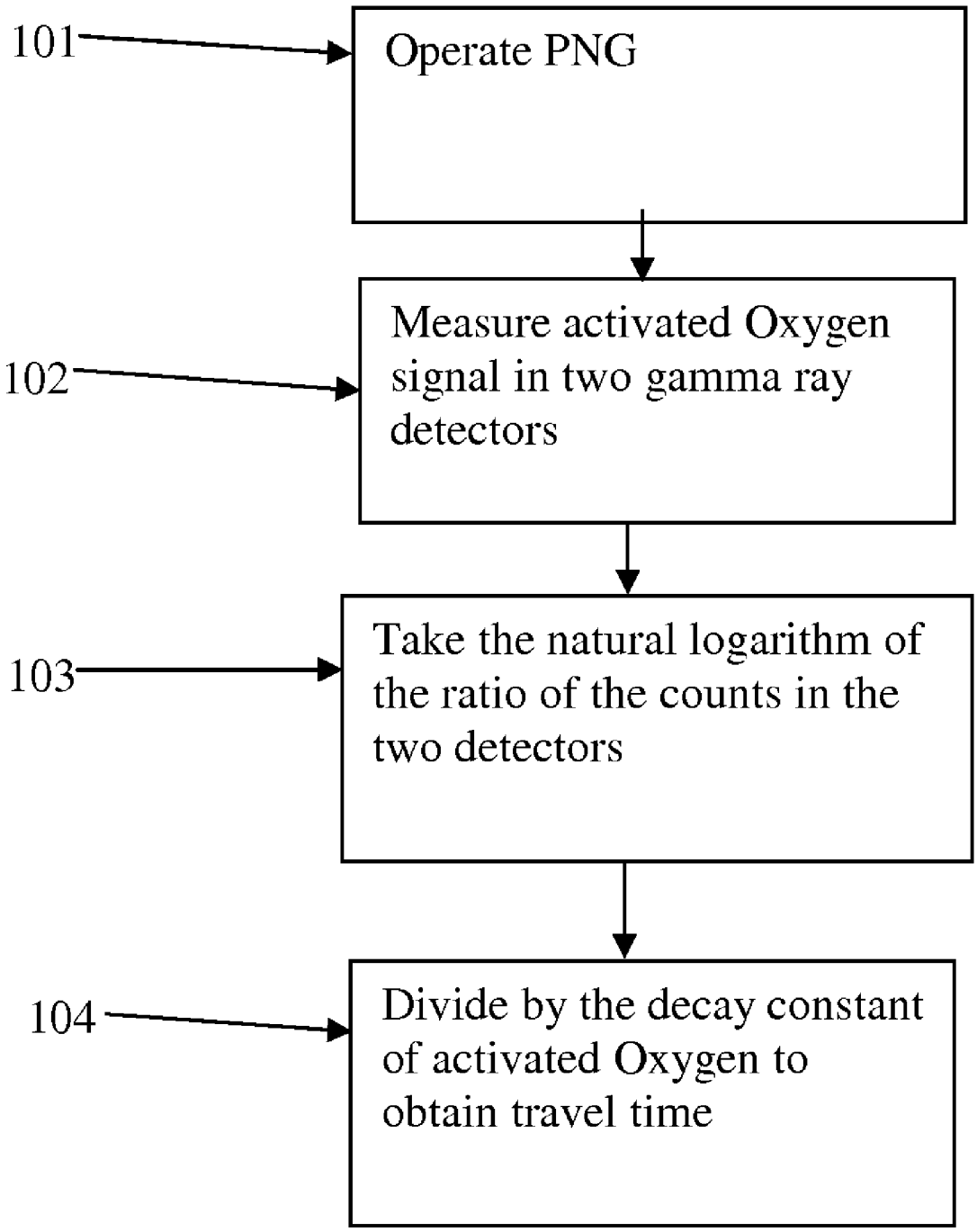
FIG. 3 shows a flow chart of an embodiment of a method of the present invention for determining a time-of-flight.

FIG. 3 shows a flow chart in accordance with the first embodiment of the present invention. In step 101, the PNG is operating and oxygen contained in the mud is being activated as it passes the PNG. In step 102, the amount of gamma ray radiation emitted by the decay of activated oxygen is measured by two detectors above the PNG. In step 103, a processing unit, such as the processor 21 in FIG. 2, may be used to take the natural logarithm of the ratio of the two numbers, and in step 104 this number may be divided by the decay constant of activated oxygen to obtain the travel time for the mud to pass between the two detectors. One of ordinary skill in the art may appreciate that instead of using a logarithm based on the number e other based logarithms may be used in embodiments of the present invention and combined with a different constant of proportionality to obtain the travel time. Merely by way of example, if the base of the logarithm is 2, then the logarithm of the ratio of the amplitudes must be multiplied by the half-life of the decay of activated oxygen.

Figure 4:
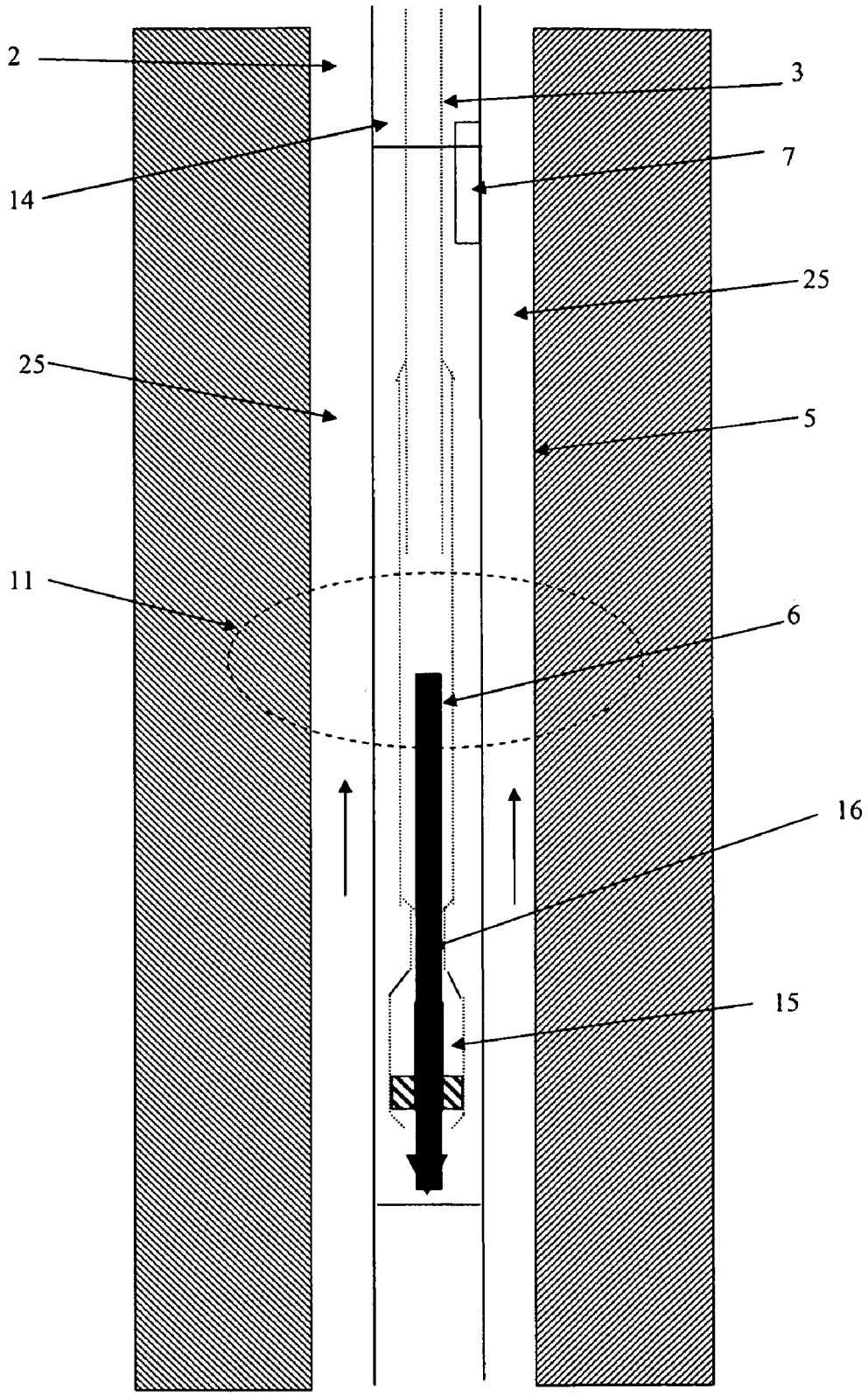
FIG. 4 shows an LWD tool, in accordance with a second embodiment of the present invention.
Figure 5:
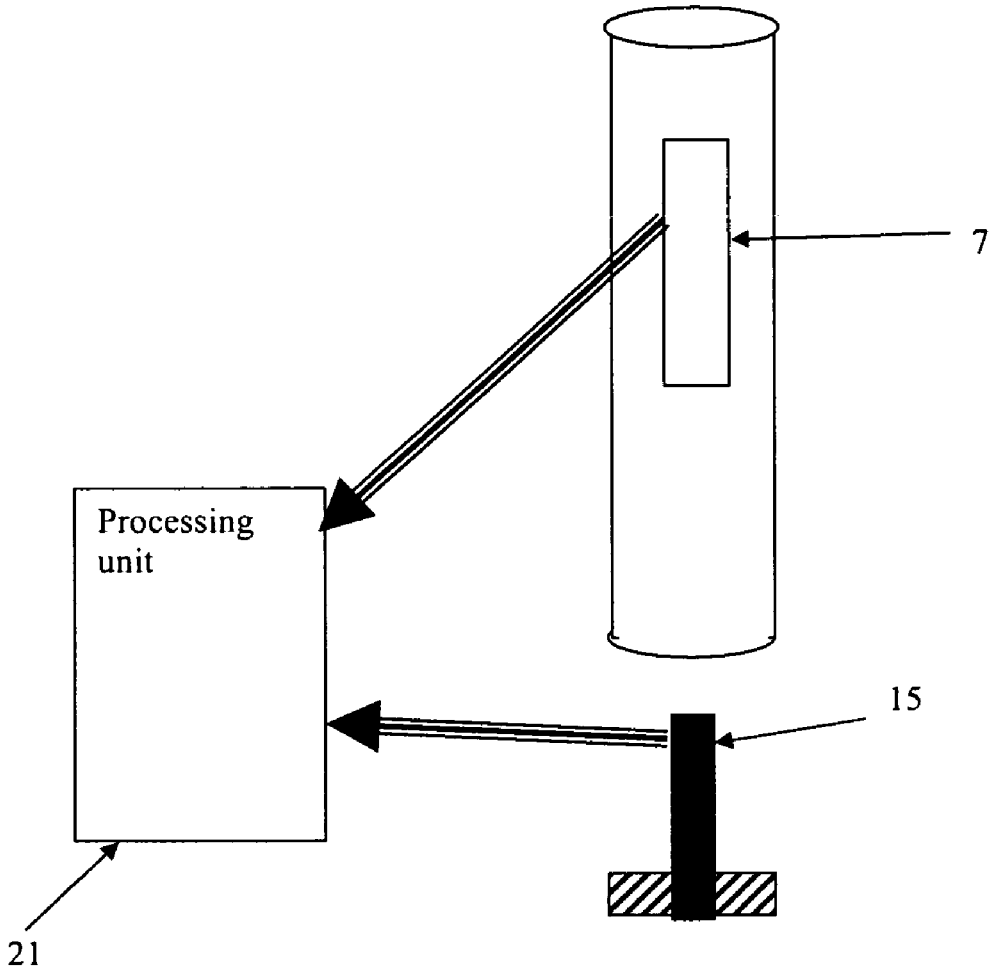
FIG. 5 shows a schematic diagram of circuitry in accordance with the second embodiment of the present invention.

In a second embodiment of the present invention, illustrated in FIG. 4, only one gamma ray detector 7 is employed, together with a second means 15 of determining the mud flow velocity at particular times. In FIG. 3 the flow measurement may be a turbine-based flow rate measurement. As illustrated, the mud flows through the drillstem in a channel 16, which drives the turbine 15, the voltage from which can be used to derive a flow rate. Other means of determining the mud flow velocity at particular times include using the PNG to directly determine time-of-flight, by inference from the rate at which mud is being pumped into the well at the surface and/or the like.

At a time when the mud flow velocity may be determined using means 15, the gamma ray amplitude may be measured at the detector 7. From the known mud flow velocity, the time required for the mud to traverse the distance between the PNG and the detector may be calculated. The gamma ray amplitude may be measured at detector 7 at times when the mud flow velocity is not known. The amplitude as measured at the detector depends both on the amount of activated oxygen contained in the mud, and on the travel time between the PNG and the detector. At normal mud velocities, the amount of activated oxygen in the mud is proportional to the time the mud is within the activation zone 11, and hence is also proportional to the travel time between the PNG and the detector. If $t_0$ is the calculated time-of-flight between the PNG and the detector 7, when the measured gamma ray amplitude is $b_0$ then the time-of-flight $t_2$ for measured detector amplitude $b_2$ may be given by:

$$t_2 + \frac{1}{\beta}\log(t_2) = t_0 + \frac{1}{\beta}\log(t_0) + \frac{1}{\beta}\log\left(\frac{b_2}{b_0}\right) \tag{2}$$

FIG. 4 shows a schematic of components configured in accordance with a second embodiment of the present invention. A measurement of the amplitude of gamma radiation $b_0$ received at the gamma ray detector 7 may be made at the same time as a measurement flow-related measurement is made at a measuring device 15 from which the travel time $t_0$ between the PNG and the detector 7 may be inferred. For instance, if the measurement device 15 is a downhole turbine that measures the volumetric flow rate of the mud, the travel time is the volumetric flow rate, divided by the cross-sectional area of the annulus, multiplied by the distance between the PNG and the detector.

The measurement device 15 may be downhole, or in some circumstances it may be at the surface—such as a flow rate derived from mud pump instrumentation. This measurement is made at a time when it is believed that the same volumetric flow of mud is passing the PNG as is being measured by the device 15. For example, while the surface mud flow rate is constant, and there is no lost circulation or influxes into the well. The gamma ray amplitude $b_0$ may be communicated to a processing unit 21 together with the travel time $t_0$. At a latter time, when it is believed that the measuring device 15 is not providing an accurate measurement of mud flow rate, the amplitude $b_2$ measured by the gamma ray detector 7 may be combined with the stored numbers $b_0$ and $t_0$, in accordance with equation 2, to derive the transit time of mud from the PNG to the detector 7. In accordance with this embodiment of the invention it may also be possible to make the measurements of $t_0$ and $b_0$ after that of $b_2$, but the travel time may not then be calculated until $t_0$ and $b_0$ have been measured.

Figure 6:
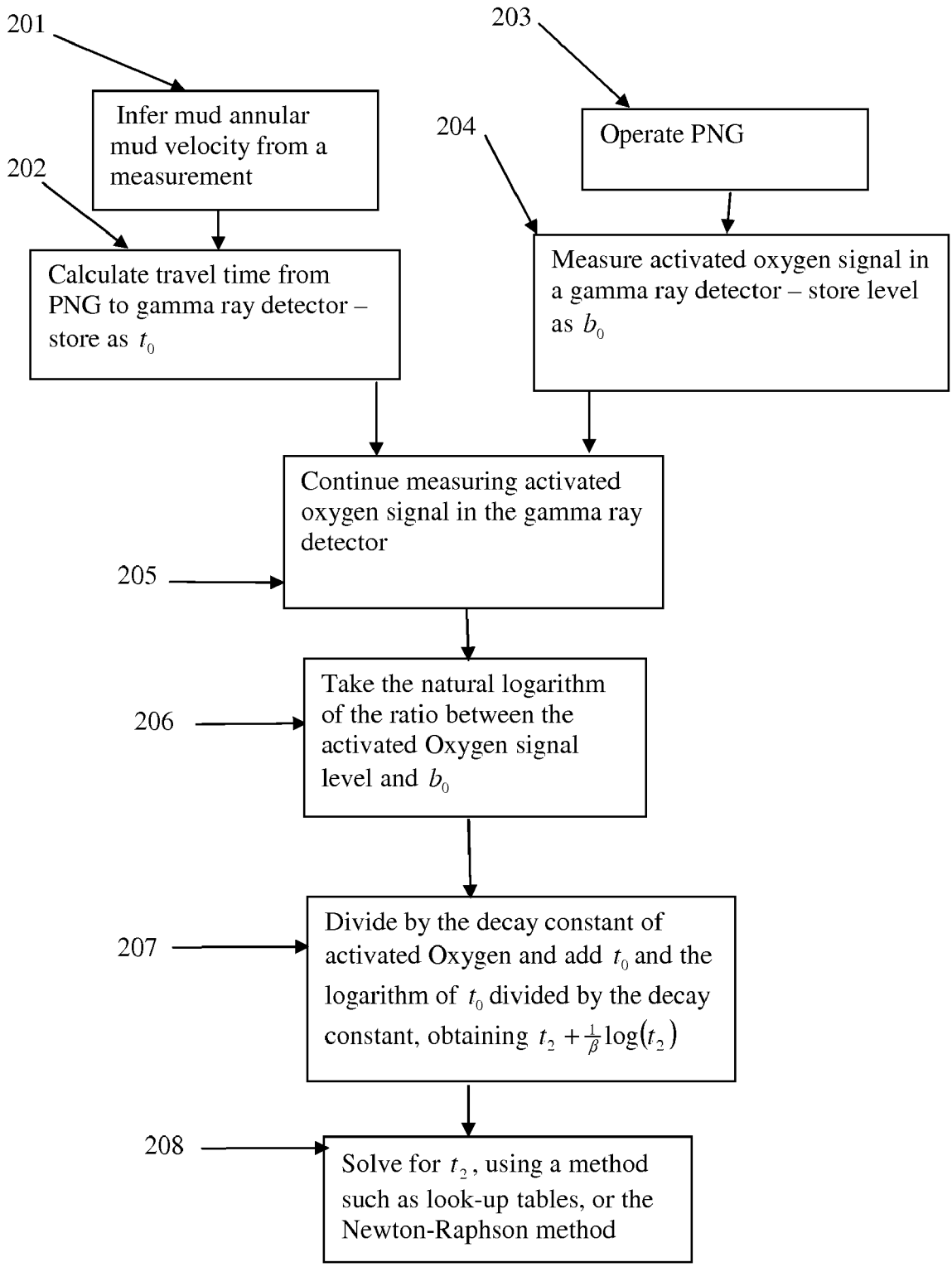
FIG. 6 shows a flow chart of the second embodiment of the method of the present invention for determining a time-of-flight.

FIG. 6 shows a flow chart of the operations that may be used to perform the method of the second embodiment of the present invention. In step 201, the velocity of the mud in the annulus is calculated based on a measurement, and from this, in step 202, the travel time of the mud from the PNG to the detector is calculated. At the same time, in step 203, the PNG is operating, and in step 204, the level of the activated oxygen signal present in a detector may be measured. The travel time and the signal level are both stored. In step 205 at another time, generally subsequent to steps 201 to 204, the gamma ray detector may be used to measure the level of activated oxygen present in the mud.

In step 206, the natural logarithm of the ratio between the signal level and the stored signal level $b_0$ may be calculated, and in step 207, this value may be divided by the decay constant of activated oxygen, and then the time $t_0$ and the logarithm of $t_0$ divided by the decay constant may be added to obtain the sum of the travel time of the mud between the PNG and the detector, and the logarithm of the travel time may be divided by the decay constant. Finally in step 208, the travel time may be found from this sum using one of many methods that persons of ordinary skill in the art may appreciate, such as the use of look-up tables, the Newton-Raphson method and/or the like. As in the previous embodiment, one of ordinary skill in the art may appreciate that the use of logarithms to different bases may also be used in step 206, in accordance with embodiments of the present invention.

In certain aspects, the apparatus described in the first embodiment may be combined with an independent means of measuring the fluid flow rate to obtain a system and method such as the second embodiment. The two methods may then be used with this apparatus to obtain the travel time from the PNG to the first detector 7 and the travel time from the first detector 7 to the second detector 8. If the mud speed is constant over the whole distance between the PNG and the second detector, these two travel times will be proportional to the two relevant distances, and the two equations (1) and (2) may be solved together to obtain the best solution with the constraint that:

$$\frac{t_1}{t_2} = \frac{d_1}{d_2} \tag{3}$$

where $d_2$ is the distance of the closest detector from the PNG and $d_1$ is the distance between the detectors. The values of $t_1$ and $t_2$ may be found, subject to equation (3), for which the quantity D $$D = \alpha\left(t_1 - \frac{1}{\beta}\log\left(\frac{b}{a}\right)\right)^p + \beta\left(t_2 + \frac{1}{\beta}\log(t_2) - t_0 - \frac{1}{\beta}\log(t_0) - \frac{1}{\beta}\log\left(\frac{b_2}{b_0}\right)\right)^p \quad (4)$$

is minimized, for some chosen positive numbers α, β and p—where in certain aspects these chosen positive numbers may have values 1, 1 and 2 respectively.

Figure 7:
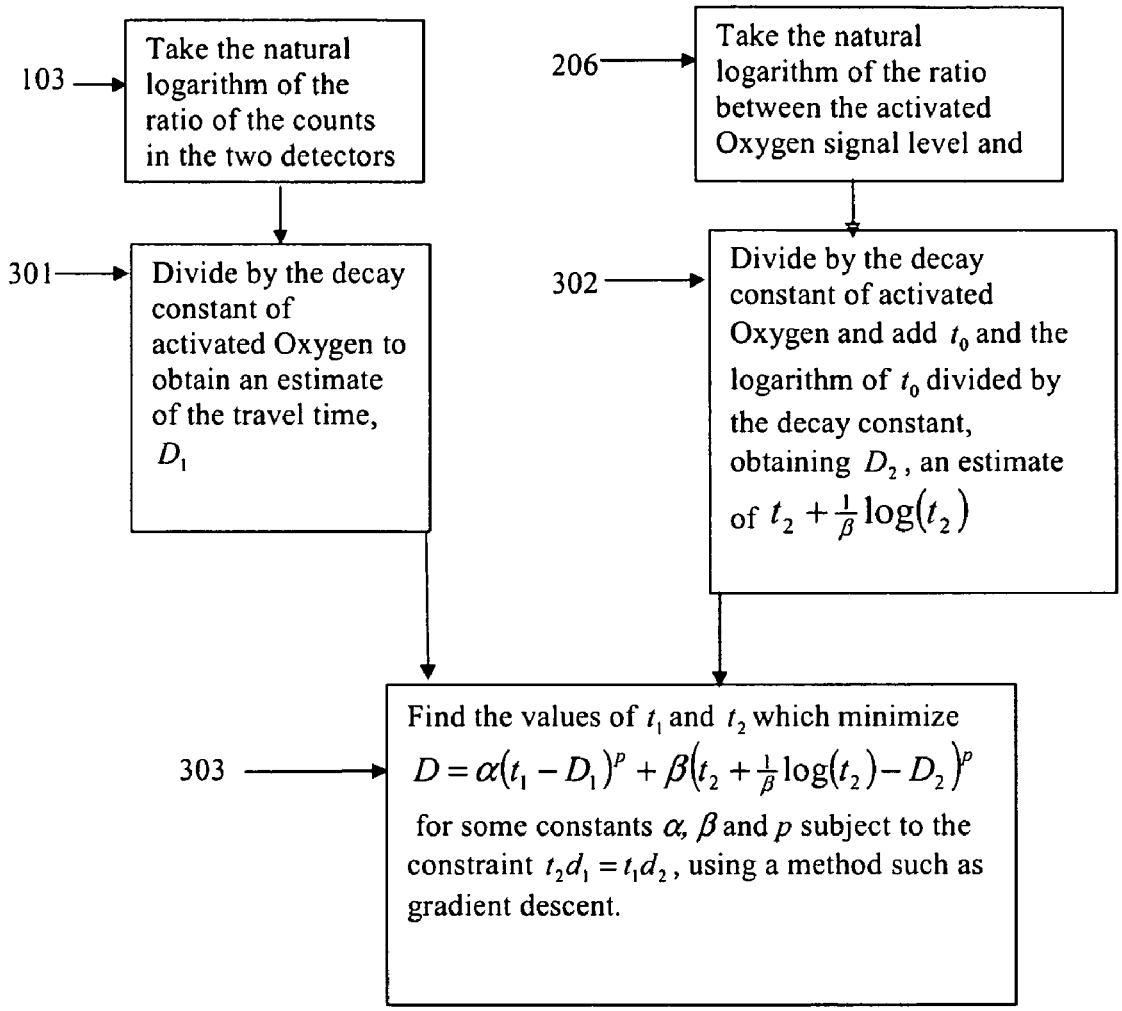
FIG. 7 shows a flow chart for combining the first and second embodiments of the present invention in determining two times-of-flight.

FIG. 7 shows a flow chart illustrating the steps to perform the operations combining the first and second embodiments of the present invention. The flow chart leads on from steps 103 and 206 of FIGS. 3 and 6. In step 301 the term $$\frac{1}{\beta}\log\left(\frac{b}{a}\right)$$

is calculated, which is then denoted as $D_1$. In step 302, the term $$t_0 + \frac{1}{\beta}\log(t_0) + \frac{1}{\beta}\log\left(\frac{b_2}{b_0}\right)$$

is calculated, which is then denoted as $D_2$. Finally in step 303, the values of $t_1$ and $t_2$ are found, subject to the constraint of equation (3), that minimize the value of D, as shown in equation (4). There are many methods for doing this step, such as gradient descent processing or the like.

Those skilled in the art may appreciate that if more than two detectors are present, the definition of the quantity D in equation (4) may be generalised to include further ratios of activation levels in order to improve the accuracy of the measurement.

The gamma ray detector 7 may be any conventional detector used in a neutron/gamma ray tool. In the depicted embodiment, the energy windows of the gamma ray detector 7 are set such that gamma rays emitted by activated oxygen are detected. In alternative embodiments, the gamma ray detector 7 may be a specific detector for the gamma ray emitted by the activated oxygen.

The mud velocity in the annulus may be calculated using the time-of-flight and the known distance d between the PNG 6 and the gamma ray detector 7. Equation 5 shows one formula for calculating the mud velocity:

$$V_m = \frac{d}{t} \quad (5)$$

where d is the distance between the PNG 6 and the gamma ray detector 7, t is the time-of-flight, and $V_m$ is the velocity of the mud.

The mud velocity may then be used to compute other downhole parameters. One such parameter that may be computed using the mud velocity is the mud volumetric flow rate.

It should be noted that a slug of mud passing through the activation zone 11 in the annulus may have already passed through the activation zone 11 while flowing downward through the mud channel (not shown) through which mud is flown downwards in the LWD tool 3. Typically, this should not affect the time-of-flight measurement as described above for at least two reasons. First, the mud channel has a much smaller flow cross-section than that of the annulus. As a result, mud in the mud channel travels through the activation zone 11 inside the drill string much faster and is activated to a much smaller degree. Second, the half-life of nitrogen-16 is about 7.1 seconds. Thus, only one half of the radioactive nitrogen-16 will remain 7.1 seconds after activation. By the time the mud in the channel flows to the drill bit and returns to the LWD tool through the annulus, much of the radioactivity will have already decayed.

The output of the gamma ray detector 7 may be applied to processing circuitry, which for purposes of this example is shown simply as processor 21. The processor 21 may perform, for example, the calculation of mud velocity as set forth in Equation (3) above. In addition, the processor 21 may perform various other calculations as set forth in the embodiments below. One of ordinary skill in the art may recognize that the processor 21 may be dedicated to the functionality of this invention or, more likely, may be a processor of general functionality to the tool.

Some LWD tools may include sensors designed to directly measure the diameter of a borehole during the drilling process. One example of such a sensor is an ultrasonic sensor that determines the diameter of the borehole by measuring the time it takes an ultrasonic pulse to travel through the mud from the LWD tool, reflect off the borehole wall, and return to the LWD tool. If such a sensor is included in an LWD tool, the borehole volume over the distance "d" may be calculated from the diameter. It is frequently the case that the borehole diameter is sufficiently accurately known from the radius of the drill bit and the geometry of the drillstem. An embodiment of the invention may then be used to make a downhole measurement of the volumetric flow rate of the mud in the annulus. Specifically, assuming the borehole volume is known over the distance "d", that the tool volume is known, and that the ROP is either known or negligibly small with respect to the distance "d" (419), from Equation 5 one may determine the volumetric flow rate of the mud, as shown in Equation 6:

$$Q_{dh} = \frac{V_{bh} - V_{tool}}{t} \quad (6)$$

where t is the time-of-flight, $V_{bh}$ is the volume of the borehole over the distance "d", $V_{tool}$ is the volume of the LWD tool over the distance "d", and $Q_{dh}$ is the volumetric flow rate of the mud in the region between the PNG and the gamma ray detector. Although the volumetric flow rate of the mud is known at the surface, the sub-surface measurement is useful as it provides an indication of fluid loss into the formation.

The methods according to this invention may be accurate in boreholes where the diameter does not vary significantly. This is because both the level of activated oxygen in the mud, and the signal the gamma ray detectors receive depend on the shape and size of the volume of mud surrounding them—and thus a changing diameter may cause changes in amplitude that may be misinterpreted as travel-time changes. The method of certain embodiments of the present invention, may be effective in circumstances where the drillstring is in the same position in the hole or only very slowly moving along it, but the mud flow rate is changing fast.

Such a situation occurs before and after connections, when lengths of pipe are added to the drillstem. Before the pipe is added, the drillstem is held stationary in the hole, and the mud pumps are turned off. When drilling is to be resumed, before the drill bit is lower to the bottom of the hole, the mud pumps are turned back on. It often occurs that the coincident change in bottom hole pressure results in fluid leaving the formation as the mud flow decreases, and entering the formation when the mud flow increases again. The methods according to this invention may be especially well suited to monitoring this process and quantifying the fluid flows occurring below the PNG during connections.

The above-described equations assume that the rate-of-penetration (ROP) of the drill bit is negligible compared to the distance "d". In most circumstances, this assumption will provide good results. Nonetheless, as noted above, the methods of the invention may be adapted to take into account the rate-of-penetration of the drill bit in those cases where it cannot be ignored.

The ROP can be accounted for by reducing the distance between the PNG and the gamma ray detector by the distance traveled by the drill string during the time-of-flight measurement. The distance traveled by the drill string is equal to the ROP times the time-of-flight. Thus, Equation 3 may be rewritten to account for the ROP as:

$$V_m = \frac{d - (ROP \cdot t)}{t} \tag{7}$$

where ROP is the rate of penetration, d is the distance between the PNG and the gamma ray detector, t is the time-of-flight, and $V_m$ is the mud flow velocity. Likewise, Equations 2-4 may be adapted to account for the ROP by replacing d with the distance d−(ROP×t).

A method according to the invention may also be used in the downward direction, i.e., while the mud is travelling down the drill string. As described earlier, the mud in the mud channel is activated when it passes through the activation zone 11 near the PNG 6. The resulting activation may be detected by one or more gamma ray detectors (not shown) disposed below the PNG 6 in the LWD tool 3. Although, in this embodiment, at least one gamma ray detector would have to be placed below the PNG in the drill string, the apparatus and methods of the invention described above would not be otherwise changed.

In the foregoing description, for the purposes of illustration, various methods and/or procedures were described in a particular order. It should be appreciated that in alternate embodiments, the methods and/or procedures may be performed in an order different than that described. It should also be appreciated that the methods described above may be performed by hardware components and/or may be embodied in sequences of machine-executable instructions, which may be used to cause a machine, such as a general-purpose or special-purpose processor or logic circuits programmed with the instructions, to perform the methods. These machine-executable instructions may be stored on one or more machine readable media, such as CD-ROMs or other type of optical disks, floppy diskettes, ROMs, RAMs, EPROMs, EEPROMs, magnetic or optical cards, flash memory, or other types of machine-readable media suitable for storing electronic instructions. Merely by way of example, some embodiments of the invention provide software programs, which may be executed on one or more computers, for performing the methods and/or procedures described above. In particular embodiments, for example, there may be a plurality of software components configured to execute on various hardware devices. Alternatively, the methods may be performed by a combination of hardware and software.

Hence, while detailed descriptions of one or more embodiments of the invention have been given above, various alternatives, modifications, and equivalents will be apparent to those skilled in the art without varying from the spirit of the invention. Moreover, except where clearly inappropriate or otherwise expressly noted, it should be assumed that the features, devices and/or components of different embodiments can be substituted and/or combined. Thus, the above description should not be taken as limiting the scope of the invention, which is defined by the appended claims.

What is claimed is:

1. A method for determining a downhole parameter in a drilling environment wherein a drill string is positioned in a borehole such that a drilling fluid supplied along the drillstring returns along an annulus around the drillstring while serving to carry drilling cuttings out of the borehole, the method comprising:

using an activation device to activate the drilling fluid flowing past the activation device;

measuring the activity level of the activated drilling fluid with a measuring device at a known distance d from the activation device;

communicating to a processor an initial measurement of the activity level at a time $t_0$ when the time-of-flight for the fluid between the activation device and the measurement device is known;

thereafter communicating further measurement of the activity level to said processor and using said processor to compare the further activity levels to the initial activity level at said time $t_0$ when the time-of-flight for the fluid between the activation device and the measurement point is known; and using said processor to device from the comparison a measurement of the time-of-flight at the time of the further activity measurement.

2. The method of claim 1, wherein the time-of-flight at time $t_0$ is derived from a downhole flow-rate measurement using a turbine.

3. The method of claim 1, wherein the time-of flight at time $t_0$ is derived from a downhole flow velocity measurement using a pulsed-neutron-generator.

4. The method of claim 1, wherein the time-of-flight at time $t_0$ is derived from a surface flow-rate measurement.

5. The method of claim 1, further comprising:

calculating drilling fluid velocity from the time-of-flight t and the known distance d.

6. The method of claim 5, wherein calculating the fluid velocity includes using a rate-of-penetration correction.

7. The method of claim 1, further comprising:

calculating a downhole volumetric flow rate from the time-of-flight t and a known borehole volume.

8. The method of claim 1, wherein the activation device is a pulsed neutron generator.

9. The method of claim 1, wherein the activated drilling fluid is detected using a gamma ray detector located in a drill string tool separated by a distance d from the activation device.

10. The method of claim 1, wherein the method is performed using a logging-while-drilling tool comprising a pulsed neutron generator which is operated continuously to measure porosity of the formation penetrated by the borehole and the same pulsed neutron generator is the said activation device activating the drilling fluid.

11. The method of claim 1 wherein the activation of drilling fluid and measuring of activity provide a continuous measurement after time $t_0$.

12. A method for determining a downhole parameter in a drilling environment wherein a drillstring is positioned in a borehole such that drilling fluid supplied along the drillstring returns along an annulus around the drillstring while serving to carry drilling cuttings out of the borehole, the method comprising:

using an activation device to activate the drilling fluid flowing past the activation device;

measuring the activity level of the activated drilling fluid with a multiplicity of measuring devices with known separations between them and known distances from the activation device;

communicating to a processor one or more initial measurements of the activity level at a time $t_0$ when the times-of-flight for the fluid between the activation device and the measurement devices are known;

thereafter communicating further measurements of the activity level to said processor and using said processor to compare the further activity levels to the one or more initial activity level s at said time $t_0$ and to one another; and using said processor to derive from the comparison a measurement of the time-of-flight at the time of the further activity measurement.

13. The method of claim 12, wherein the time-of-flight at time $t_0$ is derived from a downhole flow-rate measurement using a turbine.

14. The method of claim 12, wherein the time-of-flight at time $t_0$ is derived from a downhole flow velocity measurement using a pulsed-neutron-generator.

15. The method of claim 12, further comprising:

calculating drilling fluid velocity from the time-of-flight t and one of the known distances d.

16. The method of claim 12, wherein the method is performed using a logging-while-drilling tool comprising a pulsed neutron generator which is operated continuously to measure porosity of the formation penetrated by the borehole and the same pulsed neutron generator is the said activation device activating the drilling fluid.

17. The method of claim 12 wherein the activation of drilling fluid and measuring of activity provide a continuous measurement after time $t_0$.

* * * * *